United States Patent [19]

Langenbach, Jr. et al.

[11] Patent Number: 4,563,110

[45] Date of Patent: Jan. 7, 1986

[54] SHORING APPARATUS AND METHOD

[75] Inventors: George F. Langenbach, Jr., Crestwood; John F. Langenbach, St. Louis, both of Mo.

[73] Assignee: New T'ings Inc., St. Louis, Mo.

[21] Appl. No.: 485,838

[22] Filed: Apr. 18, 1983

[51] Int. Cl.[4] ..... E02D 27/48

[52] U.S. Cl. ..... 405/230; 405/244; 405/267

[58] Field of Search ..... 405/227, 229, 230, 244, 405/267, 269, 290; 254/98, 100

[56] References Cited

U.S. PATENT DOCUMENTS

| | | | |
|---|---|---|---|
| 332,811 | 12/1885 | Maher | 254/100 |
| 348,690 | 9/1886 | Regester | 254/100 |
| 2,982,103 | 5/1961 | Revesz et al. | 405/230 |
| 3,763,655 | 10/1973 | Galuska | 405/244 |
| 3,786,641 | 1/1974 | Turzillo | 405/230 |
| 3,796,055 | 5/1974 | Mahony | 405/230 |
| 3,855,745 | 12/1974 | Patterson et al. | 405/244 X |
| 3,902,326 | 9/1975 | Langenbach, Jr. | 405/230 |

*Primary Examiner*—David H. Corbin

*Attorney, Agent, or Firm*—Senniger, Powers, Leavitt and Roedel

[57] ABSTRACT

Apparatus for shoring a concrete slab, for example, comprising support members engageable with the bottom of the slab, a guide engageable with the support members having an internal screw thread, and piling having an external screw thread which mates with the internal screw thread of the guide. The piling is rotated about a generally vertical axis for threading it down through the guide into the ground below the slab and into engagement with load-bearing underground strata thereby to shore the slab. A method of this invention for shoring a slab is also disclosed.

41 Claims, 11 Drawing Figures

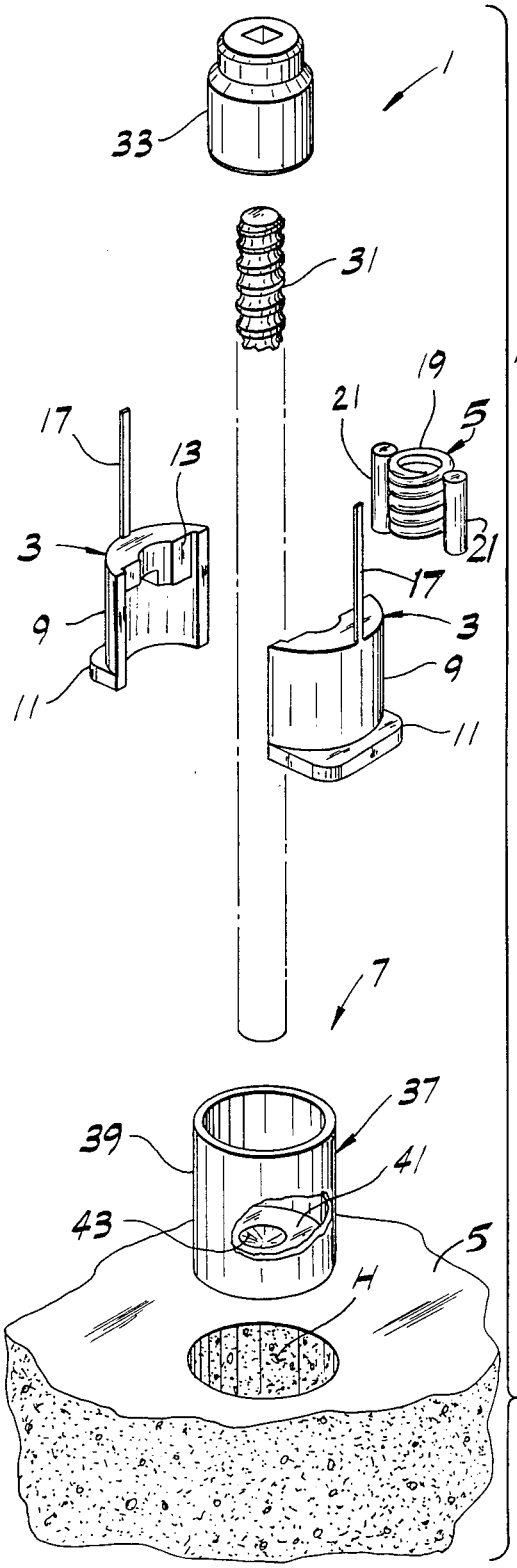
FIG. 2
FIG. 3
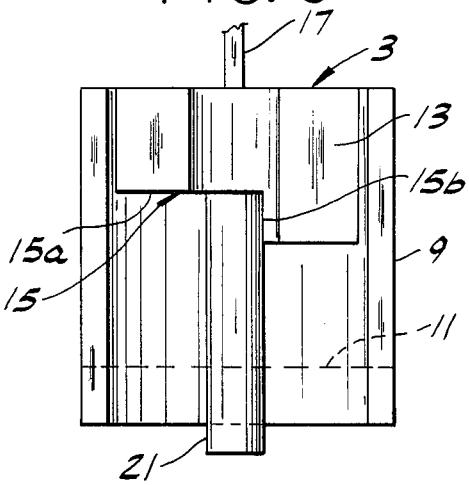
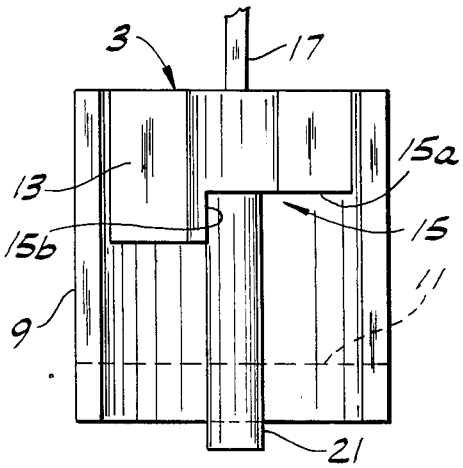
FIG. 4

SHORING APPARATUS AND METHOD

BACKGROUND OF THE INVENTION

This invention relates to apparatus for and a method of shoring a structure, such as a slab of concrete forming the floor of a building or a driveway, parking lot or road.

Houses and other buildings are often built with floors constituted by concrete slabs in direct contact with the soil therebelow. If this soil settles, sections of the slab may sag or crack. Various shoring methods are available to resolve this problem, but the most common involves a "mud pumping" process wherein a hardenable fluid mix is pumped under pressure below the slab to raise it. However, this method has serious drawbacks, especially when used inside a building inasmuch as the "mud" pumped below the slab tends to flow into surrounding pipes, ductwork, sewer systems, and other places where it may cause considerable damage. Moreover, the mud pumping process requires the use of expensive machinery and large quantities of "mud". Accordingly, the process is both costly and messy.

Shoring apparatus generally relevant to the present invention is described in U.S. Pat. Nos. 3,902,326, 3,796,055 and 2,982,103.

SUMMARY OF THE INVENTION

Among the several objects of this invention may be noted the provision of improved apparatus for shoring a slab of concrete, for example; the provision of such apparatus which is adapted for supporting the slab on load-bearing underground strata; the provision of such apparatus which is quick and easy to use; the provision of such apparatus which has an increased load-carrying capacity; the provision of such apparatus wherein the elevation at which the slab is shored may be precisely controlled; the provision of such apparatus which is economical to use and which requires very little site preparation; the provision of such apparatus which is adapted for leaving no shoring equipment visible after the shoring operation is complete; the provision of an improved method for shoring a concrete slab, for example; the provision of such a method which requires a minimum of labor, equipment and site preparation; and the provision of such a method which is easy to use and which permits the shoring job to be completed in a relatively short time and at a relatively low cost.

Generally, apparatus of the present invention for shoring a structure such as a slab of concrete comprises support means engageable with the slab, guide means associated with the support means having an internal screw thread, and piling means having an external screw thread adapted to mate with the internal screw thread of said guide means. The piling means is adapted to be rotated about a generally vertical axis for threading it down through said guide means into the ground below the slab and into engagement with load-bearing underground strata, the guide means being engageable with said support means for exerting on the support means an upward force in reaction to the downward force exerted by the piling means on the load-bearing strata thereby to shore the slab.

In another aspect of the present invention, apparatus for shoring a slab of concrete comprises a relatively slender piling member which is adapted to be lowered in a generally vertical position down through a relatively small diameter hole through the slab and driven into the ground therebelow, and bearing means positionable on the lower end of the piling member. The bearing means is expansible from a contracted position for enabling it to pass down through the hole to an expanded position for increasing the effective bearing surface of said bearing means as the piling member is driven into the ground.

The method of the present invention for shoring a structure such as a slab of concrete comprises making a first generally vertical hole through the slab, lowering a plurality of support members down into the hole and then spreading them apart to a position wherein at least a portion of each extends generally radially outwardly with respect to the hole beyond the hole below the slab for engagement with the bottom of the slab, positioning guide means adjacent the support members, and driving piling means downwardly through said guide means into the ground and into engagement with underground loadbearing strata, the guide means being adapted to exert on to the support members an upward force in reaction to the downward force exerted by said piling means on the load-bearing strata thereby to shore the slab.

Other objects and features will be in part apparent and in part pointed out hereinafter.

BRIEF DESCRIPTION OF THE DRAWINGS

FIG. 2 is an exploded view illustrating the various parts of the shoring apparatus of FIG. 1;

FIG. 3 is a vertical section on line 3—3 of FIG. 1;

FIG. 4 is a vertical section on line 4—4 of FIG. 1;

Corresponding reference characters indicate corresponding parts throughout the several views of the drawings.

DESCRIPTION OF A PREFERRED EMBODIMENT

Figure 1:
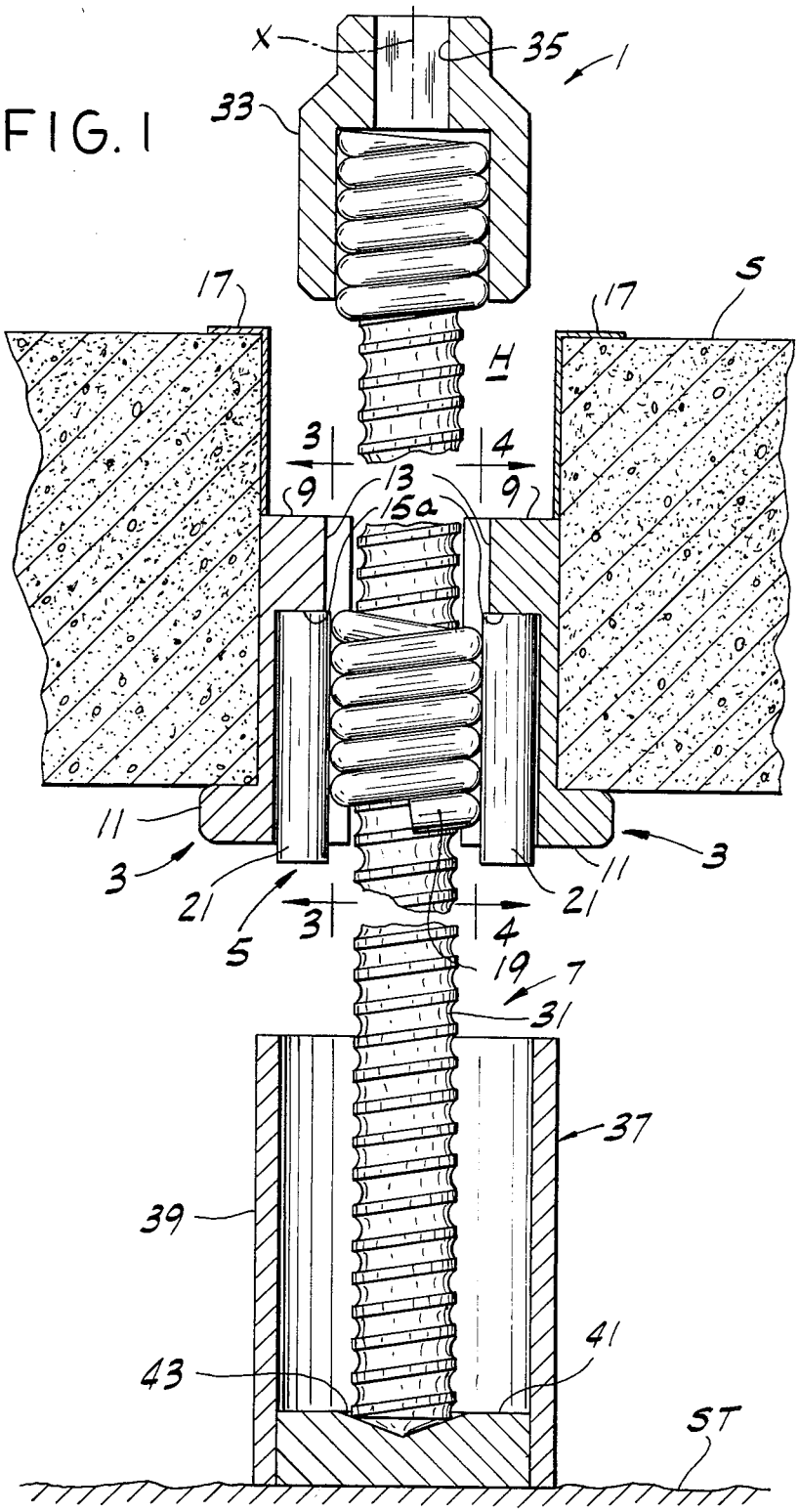
FIG. 1 is a vertical sectional elevation showing apparatus of the present invention shoring a slab of concrete.
Figure 6:
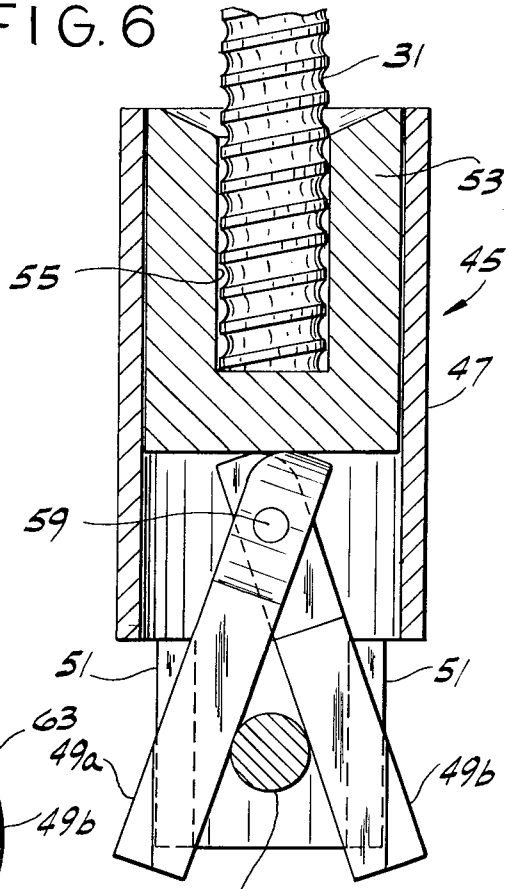
FIG. 6 is a vertical sectional elevation of expansible bearing means of the present invention in a contracted position.
Figure 7:
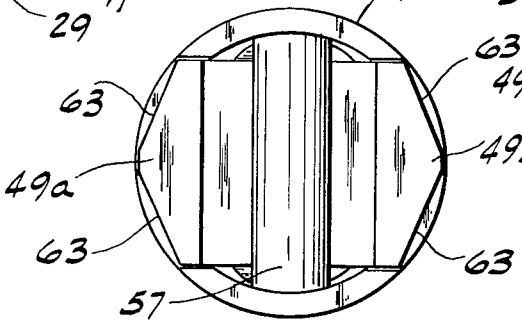
FIG. 7 is a bottom plan of FIG. 6.

Referring now to the drawings, particularly FIGS. 1 and 2, there is generally indicated at 1 apparatus of the present invention for shoring a structure such as a slab S of concrete which has settled. The slab S may form the floor of a house or building, for example, or it may constitute a section of driveway, parking lot or road.

Shoring apparatus 1 includes support means comprising a pair of support members, each generally designated 3, which are adapted to be installed in a relatively small diameter (e.g., 2 in. or 5.1 cm.) vertical hole H through the slab in a position in which they are engageable with the bottom of the slab S, guide means, generally designated 5, associated with the support members having an internal screw thread, and piling means, generally indicated at 7, having an external screw thread which is adapted to mate with the internal screw thread of guide means 5. The piling means 7 is adapted to be rotated about a generally vertical axis X (corresponding generally to the central vertical axis of hole H) for threading it down through guide means 5 and into the ground below the slab into engagement with load-bearing underground strata ST, such as hardpan or bedrock. As will more fully appear hereinafter, guide means 5 is engageable with the support members 3 for exerting on the support members an upward force in reaction to the downward force exerted by piling means 7 on the load-bearing strata ST thereby to shore the slab S.

As illustrated in FIG. 1, the support members 3 occupy positions directly opposite one another in the hole H through the slab. Each support member has a body portion 9 which extends axially (vertically) in hole H. The outer surface of the body portion adjacent the wall of the hole is arcuately shaped to conform to the curvature of the wall. A slab-engaging flange portion 11 at the lower end of the support member extends laterally outwardly from the body portion 9 for engagement with the underside of the slab S. The body portions of the support members have opposing spaced-apart generally vertical faces 13, each of which is recessed to provide a shoulder generally indicated at 15 having a downwardly facing surface 15*a* lying in a generally horizontal plane extending radially with respect to the hole, and a surface 15*b* lying in a generally vertical plane extending axially with respect to the hole. The horizontal surfaces 15*a* of the two support members are generally coplanar. The vertical surfaces 15*b*, on the other hand, lie in two different but generally parallel vertical planes on opposite sides of the central vertical axis of the hole.

Each support member 3 has an elongate vertical tab 17 extending upwardly therefrom, the upper end of the tab as shown in FIG. 1 being bent at right angles for engagement with the upper surface of the concrete slab S. This tab is useful during the initial installation of the support member in the hole H, as will be explained later in this description.

Guide means 5 comprises a guide member 19 which, in one embodiment (FIG. 1), is in the form of a coil sized and shaped for threaded engagement with piling means 7, the turns of the coil constituting the internal screw thread adapted to mate with the external screw thread on the piling means. The coil 19 has a pair of arms 21 extending axially thereof constituted by relatively short lengths of rod secured (e.g., welded) to the outside of the coil diametrically opposite one another. As shown in FIG. 1, the coil is adapted to be positioned in the hole H between the support members 3. When piling means 7 is threaded down through the coil, the coil rotates with the piling means to bring the arms 21 on the coil into engagement with the vertical surfaces 15*b* of shoulders 15 for holding the coil against rotational movement relative to the support members as piling means 7 is threaded through the coil. The arms also engage the horizontal surfaces 15*a* of shoulders 15 on the support members for exerting an upward force thereagainst in reaction to the downward force exerted by the piling means 7 on the ground therebelow.

Figure 5:
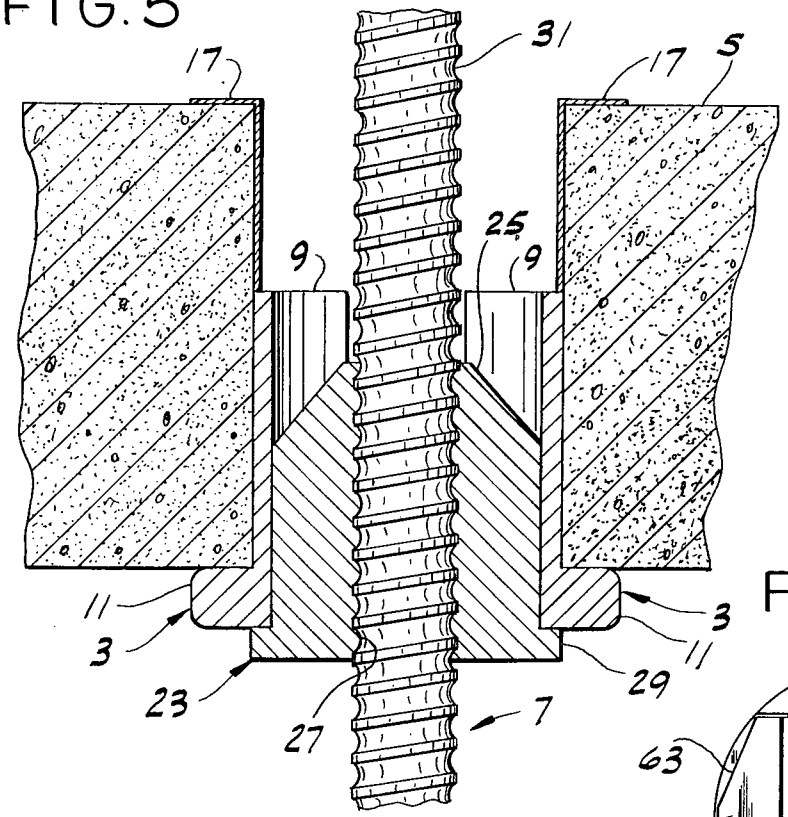
FIG. 5 is a view similar to FIG. 1 showing a modification of the shoring apparatus.
Figure 8:
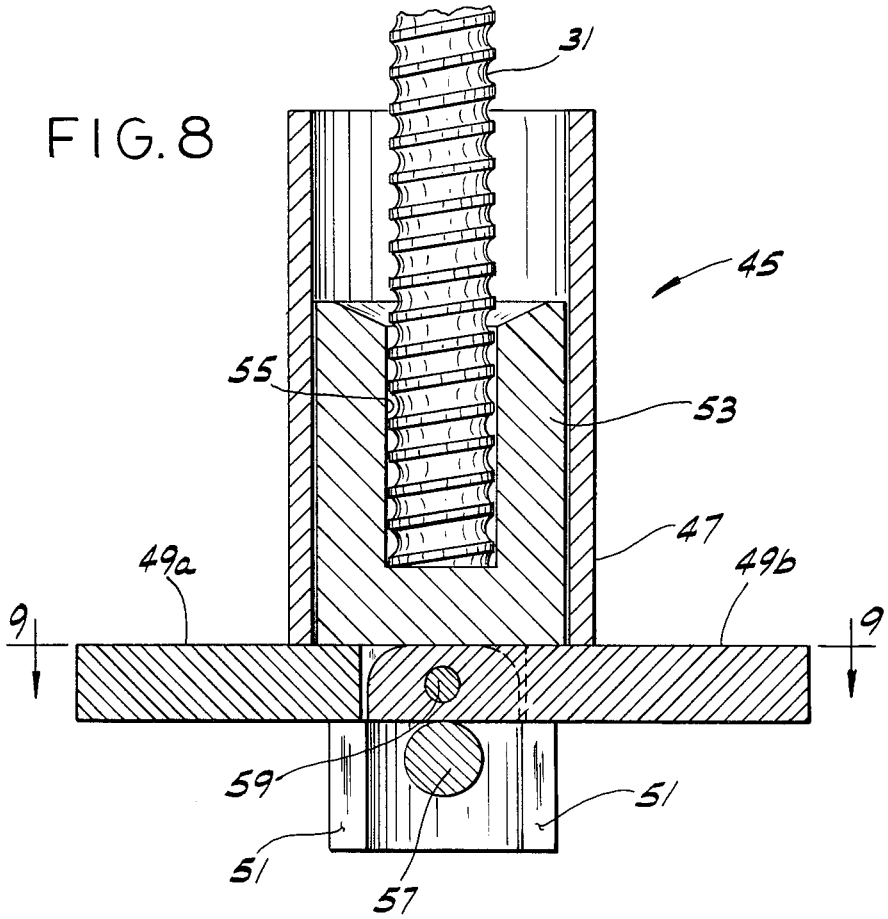
FIG. 8 is a view similar to FIG. 6 showing the bearing means in an expanded position.

An alternative guide means is shown in FIG. 5. It comprises a guide member 23 having a generally cylindric body 25 with a vertical axial opening 27 therethrough formed with an internal screw thread adapted to mate with the external screw thread on piling means 7. The guide member has a peripheral flange 29 at its lower end extending radially outwardly from the cylindric body 25. As shown, the guide member is adapted to be positioned with its body extending axially (vertically) in the hole H through the slab between the body portions 9 of the support members 3, and with its peripheral flange 29 underlying the flange portions 11 of the support members, the arrangement being such that when piling means 7 is threaded down through the guide member into the ground, the flange 29 on the guide member is pushed up into pressure engagement with the flange portions of the support members thereby to shore the slab, the friction between the flange of the guide member and the flange portions of the support members being sufficient to prevent relative rotation therebetween as piling means 7 is threaded down through the coil. It will be noted that when this guide means 23 is used, the body portions 9 of the support members 3 may be modified as shown to eliminate shoulders 15.

Piling means 7 comprises a relatively slender piling member 31 in the form of a rod having an external screw thread. The rod may be a conventional 5/8 in. (15.8 mm.) diameter rolled-thread tie rod having about four threads per inch, for example. A special fitting 33 is adapted to be attached to the upper end of the rod for use in rotating, the rod to thread down through guide means 5 (or 23) into the ground. The fitting is threadable on the rod and has a socket 35 in its upper end for receiving a wrench or the like to rotate the rod.

Piling means 7 also includes bearing means, generally designated 37, positionable on the lower end of the piling member 31 for bearing on load-bearing strata ST. In the embodiment shown in FIGS. 1 and 2, bearing means 37 comprises a cylindric cup-shaped bearing member 39 having a diameter slightly smaller than that of the hole H through the slab for enabling it to be passed down through the hole. The bearing member is open at its upper end for receiving the piling member 31 and closed at its lower end to provide a bottom 41 for the bearing member. A recess, indicated at 43, is provided in the upper surface of the bottom of the bearing member for receiving and centering the lower end of the rod.

An alternative bearing means, designated 45, is illustrated in FIGS. 6–9. It is especially adapted for use in high-load applications, such as driveways, roads and parking lots. Bearing means 45 is expansible from a contracted position (FIG. 6) for enabling it to be passed down through the relatively small diameter hole H in the slab, to an expanded position (FIG. 8) as the piling member 31 is driven into the ground for increasing the effective bearing surface of the bearing means, which results in a corresponding increase in the frictional resistance of the bearing member to downward movement. Thus, bearing means 45 increases the load-carrying capacity of shoring apparatus 1.

More particularly, expansible bearing means 45 comprises a vertical member 47 of tubular bar stock open at its upper end for receiving the lower end of the piling member 31 therein, and a pair of arms, indicated at 49*a* and 49*b* mounted in the tubular member. These arms are pivoted end to end for swinging about a generally horizontal axis from the aforesaid contracted position (FIG. 6) in which the arms assume a generally inverted V-shape and extend generally downwardly in the tubular member, to the aforesaid expanded position (FIG. 8) in which the arms assume a straightened generally horizontal configuration wherein the the arms extend laterally outwardly beyond the tubular member through notches 51 extending upwardly from the open lower end of the tubular member. A spool 53 is slidable vertically in the tubular member above the arms, the lower end of the rod being receivable in a blind vertical bore 55 in the spool for pushing the spool down against the pivoted arms for swinging them from their contracted position to their expanded position. A pin 57 mounted in the tubular member below the arms is engageable by the arms as the piling member is driven downwardly for supporting the arms and camming them apart to their expanded position.

Figure 9:
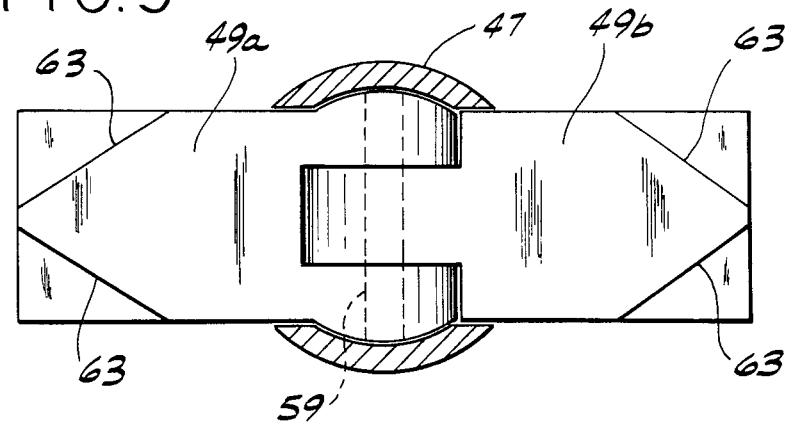
FIG. 9 is a horizontal section on line 9—9 of FIG. 8.

As best illustrated in FIG. 9, the arms 49*a*, 49*b* are constituted by two generally rectangular plates or bars, preferably of metal, hinged together end-to-end by a hinge pin 59 extending generally horizontally in the tubular member 47. The upper faces of the plates are beveled at their outer corners, as indicated at 63, so that when the arms are contracted their outer ends lie generally within a circle having a diameter not substantially greater than the diameter of the tubular member 47 for enabling the bearing member to be passed down through the hole H in slab S (see FIG. 7). As the piling member is driven downwardly the angle of the arms as they engage the ground will cause the arms to swing upwardly and outwardly into the notches 51 in the tubular member to their fully expanded position in which the arms extend generally horizontally to present a maximum amount of effective (downwardly facing) bearing surface. The arms are prevented from pivoting substantially past this horizontal position by the engagement of the arms with the tubular member at the upper ends of notches 51.

The shoring apparatus described above is used to practice the method of the present invention as follows:

Where a concrete slab (such as slab S) is to be shored, a relatively small diameter hole H is made (e.g., drilled) through the slab and into the ground to a depth somewhat greater than the overall height of bearing means 37 (or 45). The hole may be 2 inches (5.1 cm.) in diameter, for example. Bearing means 37 (or 45) is then dropped into the hole to a position in which its upper end is spaced below the bottom of the slab. Using tabs 17, the two support members 3 may thereafter be maneuvered to an initial position in which they are held close together and have a profile sufficiently narrow to permit the members to be lowered down through the hole to a position in which their body portions 9 are in the hole and their flange portions 11 are below the bottom of the slab. The support members are then spread apart to a final position (FIG. 1) in which the profile of the members is sufficiently wide that their body portions 9 are in contact with the slab S at opposite sides of the hole H and their slab-engaging flange portions extend generally radially outwardly beyond the hole and underlie the bottom of the slab on opposite sides of the hole. The upper ends of tabs 17 are then bent into engagement with the top of the slab to hold the support members in position.

With the support members in position within the hole H, guide means 5 constituted by coil 19 is preferably hand threaded up onto the lower end of the rod, and the rod then lowered into the hole to a position in which the lower end of the rod is engageable with the bottom 41 of bearing means 37 (or the spool 53 of bearing means 45), and in which the coil on the rod is positioned between the body portions of the support members. The rod is thereafter rotated on its vertical axis X by means of a wrench, for example, engageable with fitting 33 threaded on the upper end of the rod. When the rod is rotated, the coil will turn with the rod until the arms 21 on the coil engage the vertical surfaces 15*b* of shoulders 15 on the support members, at which time the coil will be held against further rotation and the rod will thread down through the coil to drive the bearing means into the ground. The upper ends of the arms on the coil abut up against the horizontal surfaces 15*a* of shoulders 15 on the support members for exerting on the support members an upward force in reaction to the downward force exerted by the bearing means as it is pushed into the ground. The rod is rotated until the bearing means 37 (or 45) reaches load-bearing strata, at which point the upward force exerted on the slab is sufficient to stabilize the slab against further settling. Further rotation of the rod will lift the slab to any desired elevation.

If guide member 23 is used instead of coil 19, the process will vary somewhat from that described above. Thus, after the bearing means 37 (or 45) has been dropped into the hole H, the guide member 23 is threaded onto the rod 31 and lowered into the hole to a position in which its upper end is at an elevation below the bottom of the slabs. Thereafter the support members are installed in the hole in the manner described above. The rod is then lifted to raise the guide member 23 to a position in which its body 25 is between the body portions 9 of the support members, and in which its peripheral flange 29 is in pressure engagement with the flange portions 11 of the support members. The conical shape of the body of the guide member serves to spread the support members apart and to force them against walls of the hole H through the slab S. The rod is then rotated to thread it down into engagement with the bearing means 37 (or 45) therebelow. Continued rotation of the rod drives the bearing means down into the ground and into engagement with load-bearing strata ST to shore the slab S (and to lift it, if necessary).

It will be understood that several piling members may have to be driven to shore a particular slab of concrete. The spacing between such piling members will depend on various factors, including loading conditions and soil characteristics.

Figure 11:
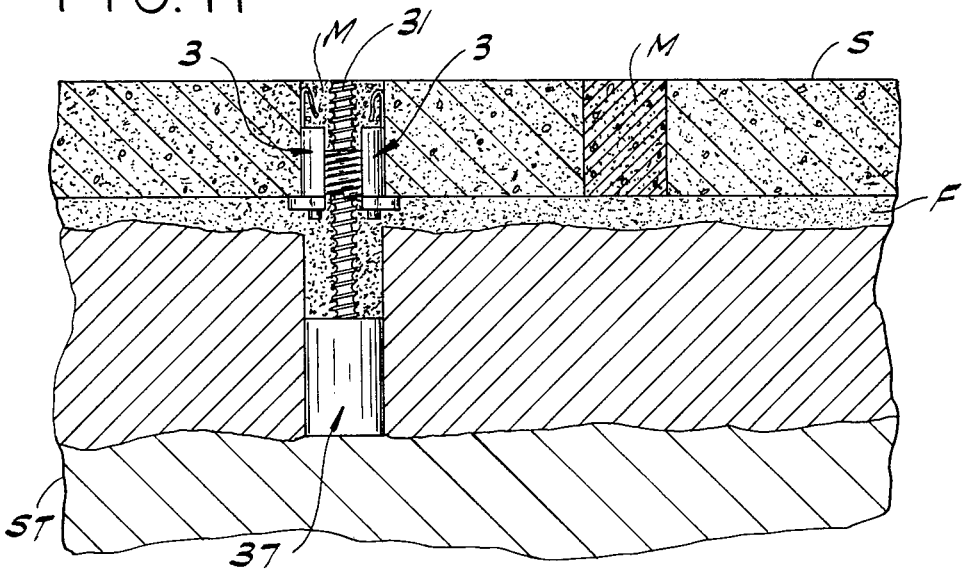

After the slab S is shored, the part of the rod projecting up above the slab is cut off flush with the top of the slab, and the hole H in the slab is filled with a hardenable material M, such as concrete (see FIG. 11). This serves to lock the rod in position (i.e., prevents it from reverse rotating) and provides a smooth surface finish to the top of the slab. Thus there is no shoring equipment visible after the job is complete. If, at a later date, further shoring of the slab is required, the concrete plug filling the hole H may be removed, the rod back-threaded out of the hole, and a new longer section of rod employed to reshore the slab in the manner described above.

Figure 10:
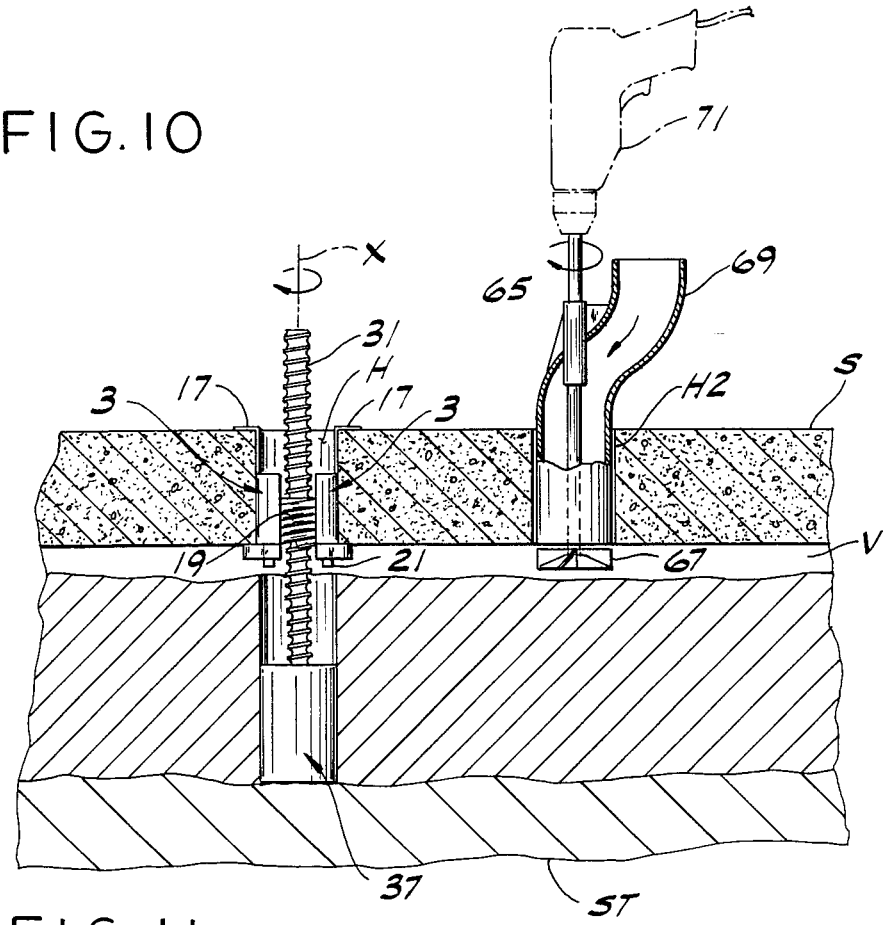
FIGS. 10 and 11 are views illustrating a method of this invention.

An optional step in the method of the present invention involves filling a void V below the slab. While filling this void may not be necessary in all instances, it may be desirable under certain circumstances. Apparatus for accomplishing this is illustrated in FIG. 10 as comprising a shaft 65 having a centrifugal impeller 67 at its lower end. This impeller is adapted to be lowered through a second hole H2 through the slab S into or adjacent the void V. Means comprising a tube 69 of suitable material is provided for feeding a solid particulate filler material (e.g., sand) to the impeller, the arrangement being such that when the shaft is turned to rotate the impeller, the filler material is slung into the void to fill it. Any suitable means 71 may be used to turn the shaft. After the void is filled, the impeller 67 is pulled back up through the hole H2. The hole is then filled with a hardenable material M such as concrete.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. Apparatus for shoring a structure such as a slab of concrete having a small-diameter hole therethrough, said hole having a central vertical axis, comprising:

support means having slab-engaging portions engageable with the bottom of said slab on opposite sides of said hole, said support means being adapted for movement from an initial position in which it has a relatively narrow profile for passage down through said hole to a final position in which it has a wider profile and in which said slab-engaging portions are adapted to project radially outwardly with respect to said axis of the hole beyond the hole below the slab for engagement with the bottom of the slab on opposite sides of the hole;

guide means associated said support means having an internal screw thread, said guide means being adapted to be positioned generally on the central vertical axis of said hole; and piling means having an external screw thread adapted to mate with the internal screw thread of said guide means, said piling means being adapted to be rotated about a generally vertical axis for threading it down through said guide means into the ground below the slab and into engagement with load-bearing underground strata, said guide means being engageable with said support means when the latter is in said final position for exerting on said support means an upward force in reaction to the downward force exerted by said piling means on said load-bearing strata thereby to shore said slab.

2. Shoring apparatus as set forth in claim 1 wherein said support means comprises a pair of separate support members, each having one of said slab-engaging portions, said support members being adapted to held close together in said initial position and adapted to be lowered in said initial position into said hole through said slab and then spread apart in a radial direction with respect to the hole to said final position in which said slab-engaging portions of the support members extend generally radially outwardly beyond the hole below the slab for engagement with the bottom of the slab.

3. Shoring apparatus as set forth in claim 2 wherein each support member has a body portion and a flange portion at one end constituting the lower end of the body portion extending laterally outwardly from the body portion, said support members being adapted to be lowered in said initial position down through the hole to a location wherein the body portions are in the hole and the flange portions are below the bottom of the slab, said members then being adapted to be spread apart to said final position in which said flange portions, constituting said slab-engaging portions, extend generally radially outwardly beyond the hole and underlie the bottom of the slab. 1

4. Shoring apparatus as set forth in claim 3 wherein the body portions of said support members are shaped to conform to the curvature of the wall of the hole.

5. Shoring apparatus as set forth in claim 3 wherein each support member has a first downwardly facing surface engageable by said guide means for the exertion thereagainst of said upward reactionary force, and a second surface engageable by said guide means for holding the guide means against rotation relative to the support member as the piling means is threaded through the guide means.

6. Shoring apparatus as set forth in claim 5 wherein said body portions of the support members have opposing generally vertical faces, each face being recessed to provide a shoulder having said first and second surfaces, said guide means having a pair of arms thereon engageable with said shoulders as the piling means is threaded through said guide means.

7. Shoring apparatus as set forth in claim 6 wherein said guide means comprises a guide member in the form of a coil having turns constituting said internal screw thread, said arms extending axially with respect to the coil on the outside of the coil.

8. Shoring apparatus as set forth in claim 3 wherein said guide means comprises a guide member having a generally cylindric body with a vertical axial opening therethrough formed with said internal screw thread, and a peripheral flange at the lower end of the body extending radially outwardly from the body, said guide member being adapted to be positioned with its body extending axially in said hole between the body portions of said support members and with its peripheral flange underlying the bottom of the flange portions of said support members whereby when said piling means is threaded downwardly through said guide member and into the ground, the flange on the guide member is adapted to be pushed upwardly into pressure engagement with the flange portions of the support members.

9. Shoring apparatus as set forth in claim 8 wherein the upper end of the body of said guide member is generally conical in shape to facilitate upward entry of the guide member between the body portions of said support members.

10. Shoring apparatus as set forth in claim 1 wherein said piling means comprises a threaded rod, and means at the lower end of the rod for bearing on said load-bearing strata.

11. Shoring apparatus as set forth in claim 10 wherein said bearing means is expansible as the rod is threadably driven down into the ground from a contracted position to an expanded position for increasing the effective bearing surface of said bearing means.

12. Shoring apparatus as set forth in claim 11 wherein said bearing means comprises a pair of arms pivoted for swinging from said contracted position in which they extend generally downwardly to said expanded position in which they extend generally laterally outwardly with respect to the rod.

13. Shoring apparatus as set forth in claim 12 wherein said bearing means further comprises a vertical tubular member open at its upper end for receiving the lower end of said rod therein, said arms being pivoted end to end and being mounted in said tubular member for pivoting about a generally horizontal axis between said contracted position in which the arms assume a generally inverted-V shape, and said expanded position in which the arms assume a straightened generally horizontal configuration wherein the arms extend laterally outwardly beyond said tubular member, and a spool slidable vertically in the tubular member above the arms, the lower end of the rod being engageable with the spool for pushing it down against the pivoted arms for swinging them from their contracted position to their expanded position.

14. Shoring apparatus as set forth in claim 10 further comprising means adapted to be attached to the upper end of the rod for use in rotating the rod to thread it down through said guide means.

15. Shoring apparatus as set forth in claim 14 wherein said rotating means comprises a fitting threadable on the upper end of the rod, said fitting having a socket therein for receiving a wrench or the like to rotate the rod.

16. Shoring apparatus as set forth in claim 1 further comprising means for filling a void below said slab after the slab has been shored.

17. Shoring apparatus as set forth in claim 16 wherein said filling means comprises an impeller adapted to be positioned in or adjacent said void, and means for rotating the impeller to sling a supply of filler material into the void to fill it.

18. Shoring apparatus as set forth in claim 17 further comprising means for feeding a supply of filler material to the impeller.

19. Apparatus for shoring a slab of concrete or the like having a small-diameter hole there-through, said hole having a central vertical axis, comprising:

support means having slab-engaging portions engageable with the bottom of said slab on opposite sides of said hole, said support means being adapted for movement from and initial position in which it has a relatively narrow profile for passage down through said hole to a final position in which it has a wider profile and in which said slab-engaging portions are adapted to project radially outwardly with respect to said axis of the hole beyond the hole below the slab for engagement with the bottom of the slab on opposite sides of the hole;

guide means associated with said support means adapted to be positioned generally on the central vertical axis of said hole; and piling means adapted to be inserted into the hole and driven downwardly through said guide means and into the ground into engagement with underground load-bearing strata, said guide means being adapted to exert on said support means when the latter is in said final position an upward force in reaction to the downward force exerted by said piling means on said load-bearing strata thereby to shore said slab.

20. Apparatus as set forth in claim 19 wherein said guide means has an internal screw thread an said piling means has a mating of external screw thread whereby said piling means may be threaded downwardly through said guide means into the ground.

21. Apparatus as set forth in claim 20 wherein said support means comprises a pair of support members, each having one of said slab-engaging portions, said support members being adapted to be held close together in said initial position and adapted to be lowered in said initial position into said hole through said slab and then spread apart in a radial direction with respect to the hole to said final position in which said slab-engaging portions of the support members extend generally radially outwardly beyond the hole below the slab for engagement with the bottom of the slab.

22. Apparatus as set forth in claim 21 wherein each support member has a body portion and a flange portion at one end constituting the lower end of the body portion extending laterally outwardly from the body portion, said support members being adapted to be lowered into the hole to a position in which the body portions are in the hole and the flange portions are below the bottom of the slab, said support members then being adapted to be spread apart to said final position in which said flange portions, constituting said slab-engaging portions, extend generally radially outwardly beyond the hole and underlie the bottom of the slab.

23. Apparatus as set forth in claim 21 wherein each support member has a first downwardly facing surface engagable by said guide means for the exertion thereagainst of said upward reactionary force, and a second surface engageable by said guide means for holding the guide means against rotation relative to the support members as the piling member is threaded down through the guide means.

24. Apparatus as set forth in claim 23 wherein said body portions of the support members have opposing generally vertical faces, each face being recessed to provide a shoulder having said first and second surfaces, said guide means having a pair of arms thereon engageable with said shoulders as the piling means is threaded through said guide means.

25. Apparatus as set forth in claim 24 wherein said guide means comprises a guide member in the form of a coil having turns constituting said internal screw thread, said arms extending axially with respect to the coil on the outside of the coil.

26. Apparatus as set forth in claim 20 wherein said guide means comprises a guide member having a generally cylindric body with a vertical axial opening therethrough formed with said internal screw thread and a peripheral flange at the lower end of the body extending laterally outwardly from the body, said guide member being adapted to be positioned with its body extending axially in said hole between the body portions of said support members and with its peripheral flange underlying the flange portions of said support members whereby when said piling means is threaded downwardly through said guide member and into the ground, the flange on the guide member is adapted to be pushed upwardly into pressure engagement with the flange portions of the support members.

27. Apparatus as set forth in claim 26 wherein the upper end of the body of said guide member is generally conical in shape to facilitate upward entry of the guide member between the body portions of said support members.

28. Apparatus as set forth in claim 19 wherein said piling means comprises a relatively slender piling member drivable down into the ground, and bearing means at the lower end of the piling member for bearing on said load-bearing strata.

29. Apparatus as set forth in claim 28 wherein said bearing means is expansible as the piling member is driven into the ground from a contracted position to an expanded position for increasing the effective bearing surface of said bearing means.

30. Apparatus as set forth in claim 29 wherein said bearing means comprises a pair of arms pivoted for swinging from said contracted position in which they extend generally downwardly to said expanded position in which they extend generally laterally outwardly with respect to of the piling member.

31. Apparatus as set forth in claim 30 wherein said bearing means further comprises a vertical tubular member open at its upper end for receiving the lower end of said piling member therein, said arms being pivoted end to end and being mounted in said tubular member for pivoting about a generally horizontal axis between said contracted position in which the arms assume a generally inverted-V shape, and said expanded position in which the arms assume a straightened generally horizontal configuration wherein the arms extend laterally outwardly beyond said tubular member, and a spool slidable vertically in the tubular member above the arms, the lower end of the rod being engageable with the spool for pushing it down against the pivoted arms for swinging them from their contracted position to their expanded position.

32. Apparatus for shoring a slab of concrete or the like, comprising a relatively slender piling member adapted to be lowered in a generally vertical position down through a relatively small diameter hole through the slab and driven into the ground therebelow, and bearing means positionable at the lower end of the piling member, said bearing member being expansible from a contracted position for enabling it to pass down through said hole to an expanded position for increasing the effective bearing surface of said bearing means as the piling member is driven into the ground, said bearing means comprising a pair of arms pivoted for swinging between said contracted position in which they extend generally downwardly to said expanded position in which they extend generally laterally outwardly with respect said piling member, a vertical tubular member open at its upper end for receiving the lower end of said piling member therein, said arms being pivoted end to end and being mounted in said tubular member for pivoting about a generally horizontal axis between said contracted position in which the arms assume a generally inverted-V shape, and said expanded position in which the arms assume a straightened generally horizontal configuration wherein the arms extend generally laterally outwardly beyond said tubular member, and a spool slidable vertically in the tubular member above the arms, the lower end of the piling member being engageable with the spool for pushing it down against the pivoted arms for moving them from their contracted to their expanded position.

33. Shoring apparatus as set forth in claim 32 further comprising means inside the tubular member engageable by the arms as the piling member is driven downwardly for assisting in the movement of the arms to said expanded position.

34. Shoring apparatus as set forth in claim 32 wherein said tubular member is open at its lower end and has a pair of diametrically opposing notches therein extending upwardly from its lower end, said arms being swingable upwardly and outwardly into said notches as they pivot from their contracted position to their expanded position.

35. A method of shoring a structure, such as a slab of concrete, comprising:

making a first generally vertical hole through the slab, said hole having a central generally vertical axis;

providing support means having slab-engaging portions engageable with the bottom of the slab on opposite sides of the hole;

holding said support means in an initial position in which it has a relatively narrow profile to permit passage through said hole, lowering said support means in said initial position down through the hole, and then maneuvering said support means to a final position in which it has a wider profile wherein said slab-engaging portions project generally radially outwardly with respect to said central axis of the hole beyond the hole below the slab for engagement with the bottom of the slab at opposite sides of the hole;

positioning guide means associated with said support means generally on said central vertical axis of the hole; and driving piling means downwardly through said guide means into the ground and into engagement with underground load-bearing strata, said guide means being adapted to exert on said support means when the latter is in said final position an upward force in reaction to the downward force exerted by said piling means on said load-bearing strata thereby to shore said slab.

36. A shoring method as set forth in claim 35 wherein said support means comprises a plurality of separate support members, each having one of said slab-engaging portions, said method comprising holding said members close together in said initial position, lowering said members in said initial position down through the hole, and then spreading said members apart to said final position.

37. A shoring method as set forth in claim 36 wherein said guide means and said piling means have mating internal and external screw threads, said method of further comprising rotating said piling means on a generally vertical axis thereby to thread it down through said guide means into the ground.

38. A shoring method as set forth in claim 37 wherein said guide means comprises a part separate from said support members, said method further comprising positioning said guide means between said support members when the latter are in said final position.

39. A shoring method as set forth in claim 37 further comprising filling in a void below said slab after the slab has been shored by making a second generally vertical hole through the slab, lowering an impeller down through the hole to a position in which the impeller is in or adjacent said void, feeding a supply of filler material to the impeller, and rotating the impeller to sling the filler material into the void to fill it.

40. A shoring method as set forth in claim 39 further comprising removing the impeller from the second hole after said void is filled, and filling said second hole with a hardenable material.

41. A shoring method as set forth in claim 40 further comprising filling said first hole with a hardenable material after said slab has been shored.

* * * * *

UNITED STATES PATENT AND TRADEMARK OFFICE

CERTIFICATE OF CORRECTION

PATENT NO. : 4,563,110

DATED : January 7, 1986

INVENTOR(S) : George F. Langenbach, Jr. and John F. Langenbach

It is certified that error appears in the above—identified patent and that said Letters Patent is hereby corrected as shown below:

Column 7, actual line 28, "associated said" should read -- associated with said --. Column 7, actual line 47, "to held" should read -- to be held --. Column 7, actual line 67, "slab. 1" should read -- slab. --. Column 9, actual line 32, "and initial" should read -- an initial --. Column 11, actual line 34, "respect said" should read -- respect to said --. Column 12, actual line 39, "method of" should read -- method --.

Signed and Sealed this

Twenty-seventh Day of October, 1987

*Attest:*

DONALD J. QUIGG

*Attesting Officer*

*Commissioner of Patents and Trademarks*